US010156366B2

(12) United States Patent
Braden et al.

(10) Patent No.: US 10,156,366 B2
(45) Date of Patent: Dec. 18, 2018

(54) HOME APPLIANCE HAVING AN AIR GAP INSULATOR

(71) Applicants: BSH Home Appliances Corporation, Irvine, CA (US); BSH Bosch und Siemens Hausgeräte GmbH, Munich (DE)

(72) Inventors: Ben Braden, Lafollette, TN (US); Richard Moyers, Morristown, TN (US); Timothy Russell, Jacksboro, TN (US); Michael Rutherford, Duff, TN (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 285 days.

(21) Appl. No.: 14/603,472

(22) Filed: Jan. 23, 2015

(65) Prior Publication Data

US 2016/0215987 A1 Jul. 28, 2016

(51) Int. Cl.

| | |
|---|---|
| ***F24C 15/00*** | (2006.01) |
| ***F24C 15/30*** | (2006.01) |
| ***F24C 15/32*** | (2006.01) |

(52) U.S. Cl.

CPC ..... *F24C 15/006* (2013.01); *F24C 15/001* (2013.01); *F24C 15/30* (2013.01); *F24C 15/32* (2013.01)

(58) Field of Classification Search

CPC ..... F24C 15/006; F24C 15/322; F24C 15/30
USPC ..... 126/21 A, 21 R, 15 A, 15 R, 273; 219/757

See application file for complete search history.

(56) References Cited

U.S. PATENT DOCUMENTS

| | | | | |
|---|---|---|---|---|
| 1,706,389 | A | 3/1929 | Bayliss | |
| 3,682,156 | A * | 8/1972 | Perl | F24C 15/2007 126/21 A |
| 3,883,854 | A * | 5/1975 | Heinberg | G06F 13/1647 711/109 |
| 4,184,473 | A | 1/1980 | McIntire et al. | |
| 4,383,518 | A | 5/1983 | Beausoleil | |
| 4,763,638 | A * | 8/1988 | Hurley | F24C 14/025 126/21 A |
| 4,865,010 | A * | 9/1989 | Kett | F24C 15/2007 126/21 R |
| 6,761,159 | B1 * | 7/2004 | Barnes | F24C 15/2007 126/15 R |

(Continued)

FOREIGN PATENT DOCUMENTS

| | | |
|---|---|---|
| EP | 0671591 B1 | 2/1999 |
| EP | 2489942 A1 | 8/2012 |

(Continued)

OTHER PUBLICATIONS

Draglink, Open Raods Forum, RV.net, Mar. 22, 2011, p. 22.

*Primary Examiner* — Gregory Huson
*Assistant Examiner* — Nikhil Mashruwala
(74) *Attorney, Agent, or Firm* — Michael E. Tschupp; Andre Pallapies; Brandon G. Braun

(57) ABSTRACT

A home cooking appliance includes a housing having a rear wall, a cooking compartment in the housing, an exhaust channel that exhausts air from the cooking compartment, and an air gap insulator disposed between the rear wall and the air flowing in the exhaust channel and forming an air gap between the rear wall and the exhaust channel.

39 Claims, 13 Drawing Sheets

(56) References Cited

U.S. PATENT DOCUMENTS

| | | | | |
|---|---|---|---|---|
| 7,762,250 | B2 * | 7/2010 | Elkasevic | F24C 15/006 126/190 |
| 2016/0215988 | A1 * | 7/2016 | Braden | F24C 15/006 |

FOREIGN PATENT DOCUMENTS

| | | | |
|---|---|---|---|
| KR | 100272362 | B1 | 12/2000 |
| WO | 2013098251 | A1 | 7/2013 |

* cited by examiner

HOME APPLIANCE HAVING AN AIR GAP INSULATOR

CROSS-REFERENCES TO RELATED APPLICATION

This application is related to Applicants' co-pending U.S. application, which is filed concurrently herewith, entitled "HOME APPLIANCE HAVING A SIDE SHIELD", Ser. No. 14/603,473, which is incorporated herein by reference in its entirety.

FIELD OF THE INVENTION

The present invention is directed to a home cooking appliance having a rear vent trim, and more particularly, to a home cooking appliance having a rear vent trim including an air gap insulator.

BACKGROUND OF THE INVENTION

A conventional home cooking appliance, such as a Free Standing Range (FSR), includes a housing having a cooking compartment, such as a baking oven, convection oven, steam oven, warming drawer, etc., and a cooking surface formed, for example, by cooking grates disposed over gas burners on top of the housing. A conventional range (e.g., slide-in, free standing, etc.) is installed in a cooking area of a home kitchen with a rear wall of the appliance facing a back wall of the kitchen. The appliance typically is disposed between counters with floor cabinets below the counters. The kitchen may include wall cabinets mounted on the back wall of the kitchen either over the cooking surface of the range or over the adjacent floor cabinets, and/or another appliance or component, such as an over-the-range (OTR) microwave oven or an OTR convection microwave oven over the cooking surface.

Industry standards and regulations commonly dictate acceptable temperatures of the combustible back wall behind the appliance, acceptable temperatures of cabinets or components over the range or adjacent to the range, as well as acceptable door and other surface temperatures for the appliance, during high temperature events, such as during a normal baking and/or self-cleaning cycle of the oven while all burners on the cooktop are on a highest heat setting. The appliance must be able to exhaust cooling air and flue gases from the cooking compartment to maintain acceptable door temperatures for the appliance, acceptable surface temperatures for the appliance, acceptable temperatures of a combustible back wall behind the appliance, and acceptable temperatures of cabinets or components over the range or adjacent to the range.

Conventional appliances include various structures and techniques designed to manage and dissipate the hot air being exhausted from the appliance while complying with industry standards and regulations. In order to provide enough air flow through the appliance to maintain acceptable surface temperatures and oven door temperatures and to protect components in and around the appliance, many conventional appliances use costly designs and door construction that increases the air flow through the door and the housing, and/or use greater air flow and louder fans. Additionally, conventional home cooking appliances may require a rear wall of the appliance to be spaced from the combustible back wall by a certain amount of clearance in order to manage and dissipate hot air from the appliance in order to improve compliance with the industry standards and regulations.

For example, a conventional Free Standing Range (FSR) may be provided with a rear vent trim kit or assembly, which adapts the FSR for the environment in which the FSR is placed. The FSR may include an "island" trim kit which adapts the FSR for installation in an island location, or a "low back" trim kit which adapts the FSR for placement with a rear wall of the appliance adjacent to a back wall of a home kitchen. A low back trim kit may be arranged to space the FSR away from the back wall so that air is permitted to circulate between the back wall to keep the back wall cooler than the FSR and also to provide a space into which exhaust gases and/or cooling ventilation from the FSR may be vented. The FSR can include one or more ventilation fan outlets from which the FSR exhausts cooling air. The temperature differences in the air in the space protected by the conventional low back trim kit enables a convection of air to be established in a vertical direction from the fan outlets upward into the low back trim kit and the air is guided out a vent trim opening in a back of the rear vent trim kit.

SUMMARY OF THE INVENTION

An exemplary embodiment of the invention comprises a home cooking appliance including a housing having a rear wall, a cooking compartment in the housing, an exhaust channel that exhausts air from the cooking compartment, and an air gap insulator disposed between the rear wall and the air flowing in the exhaust channel and forming an air gap between the rear wall and the exhaust channel. In this way, the present invention can reduce an amount of heat transferred from the air flowing through an exhaust channel to the rear wall of the appliance or an accessory of the appliance, thereby limiting or reducing excessive heat exposure to a back wall of the kitchen to which the wall of the appliance is adjacent.

Other features and advantages of the present invention will be described below. To provide a better understanding of the invention, and for further clarification and background of the present invention, various aspects and considerations of a home cooking appliance having a rear vent trim, which have been recognized by the present invention, first will be explained in greater detail.

As explained above, a home cooking appliance, such as a Free Standing Range (FSR), may be provided with a rear vent trim kit or assembly, which adapts the FSR for the environment in which the FSR is placed. The trim kit forms an exhaust channel that guides air from within the appliance, such as hot flue gases from the oven compartment, in a vertical direction from the fan outlets of the oven flues upward into the rear vent trim, where the exhaust air is guided out the vent opening in the rear vent trim. A rear vent trim can take various forms depending on the particular appliance, arrangement of cooking compartment(s), cooktop or burners, desired aesthetics of the appliance, and/or the location in which the appliance will be installed, such as adjacent to a kitchen wall, in a kitchen island, adjacent to cabinetry or other accessories such as a fume hood, etc., among other things. For example, the rear vent trim can be configured to be raised up from the cooking surface by various amounts such as a high back, low back, high shelf, etc., or substantially flush with the top of the appliance or cooking surface. The rear vent trim can include a vent opening for exhausting air from within the appliance. The rear vent trim can be configured to control and manage the flow of the exhausted air (e.g., hot air/flue gas) to minimize temperatures on a user and adjacent surfaces, such as surfaces of kitchen cabinetry adjacent to or above the appliance, surfaces of a combustible back wall of the kitchen, etc. In this way, the rear vent trim can improve compliance of the appliance with industry standards and regulations and maintain passing combustion results at the gas burners, while also improving comfort of a user, for example, by minimizing a temperature of air flowing toward the user, minimizing noise to the user, etc.

Some appliances are configured to be positioned such that the rear wall is close to a combustible surface, such as a back wall of a kitchen. The temperature of the rear wall of the appliance during operation of the appliance greatly affects a required minimum clearance between the rear wall of the appliance and a combustible back wall of the kitchen, which faces the rear wall of the appliance, in order to minimize heat transfer from the rear wall to the back wall of the kitchen. Given the excessive temperatures potentially seen within an exhaust channel of an oven, the present invention recognizes that, during operation of the cooking compartment, heat from the hot flue gases being exhausted through the rear vent trim can be transferred to the rear wall of the appliance, thereby increasing a temperature of the rear wall of the appliance, which may affect the required minimum clearance, compliance with industry standards, etc.

These problems and others are addressed by the present invention, which provides a home cooking appliance including a rear vent trim having an air gap insulator that is spaced off of the rear wall of the appliance, thereby protecting and establishing an air gap between the rear wall of the appliance and the upward flow of air, which flows through the exhaust channel of the rear vent trim from the oven flue(s). In this way, the present invention can provide a rear vent trim that controls a flow of air exhausting from the appliance while also reducing the amount of heat transferred from the oven exhaust vents to the rear wall of the appliance or an accessory of the appliance, thereby limiting or reducing the temperature exposure to a back wall of the kitchen to which the wall of the appliance is adjacent. The present invention also can minimize or eliminate a required minimum clearance between the rear wall of the appliance and a combustible back wall of the kitchen, which faces the rear wall of the appliance, while maintaining compliance with industry standards and regulations.

The air gap insulator can be positioned on a surface of the rear wall (e.g., an inner surface of the rear wall) that is subject to temperature increases during operation of the appliance, such as a surface that is adjacent to or directly faces the exhaust channel from the oven flues. The air gap insulator can be mounted to the rear wall and configured to form an air gap between the air gap insulator and an inner surface of the rear wall of the appliance. The air gap can reduce the amount of heat that is transferred from the air gap insulator (which is heated by the hot air that flows from the oven flue through the exhaust channel) to the rear wall. As a result, during operation of the appliance, a temperature of the rear wall is less than a temperature of the air gap insulator, which in turn limits or reduces the temperature exposure to a back wall of the kitchen to which the wall of the appliance is adjacent.

The particular location, arrangement, size, and shape of the air gap insulator can vary depending on the particular physical dimensions of one or more components of the appliance, such as an amount of available space between the flue fan exits and the deflector, the oven vent location(s), the number of oven vents or oven flues, the air flow through the exhaust channel, etc. The air gap insulator can be positioned such that the air gap insulator cannot be viewed readily by a user of the appliance through the opening of the oven vent, to provide the desired aesthetics of the appliance.

The air gap insulator can be configured to substantially close off the air gap from the air flowing in the exhaust channel, thereby minimizing or preventing hot air from the exhaust channel from directly contacting the surface of the rear wall adjacent to the air gap. The arrangement may result in a pressure difference between the air gap and the exhaust channel, and more particularly, may provide a lower pressure in the air gap than in the exhaust channel.

At the same time, the air gap insulator can be configured to loosely contact the rear wall, or to be spaced by a minimal amount or clearance from the rear wall (e.g., entirely spaced apart). As a result, the heat transfer from one solid to another solid (e.g., metal to metal) can be substantially limited to heat transfer through the one or more fixation devices, such as rivets, screws, or the like. In some example embodiments, the air gap insulator can be mounted on the appliance such that the air gap insulator does not contact, or is substantially free of contact with, the rear wall of the appliance, thereby minimizing or preventing the rear wall from conducting heat from the air gap insulator. In this way, the exemplary embodiments of the air gap insulator can significantly reduce the temperature of the rear wall of the appliance and rear vent trim assembly. This arrangement also may limit or reduce an amount of heat that is dispersed or conducted throughout the rear wall to other portions of the rear wall, away from the particular location of the air gap insulator.

Such minimal spacing or clearance between the air gap insulator and the rear wall can provide additional advantages in that the spacing or clearance can permit air (e.g., small amounts of air) to be drawn into the low pressure area of the air gap, for example, from within the appliance housing or from openings in the rear wall, which may provide some cooling of the air gap insulator and/or generate a flow of cooler air within the air gap, which may limit or reduce heat transfer from the air gap insulator to the rear wall.

The air gap insulator can be configured to provide for a smooth flow of air over the surface of the air gap insulator. For example, edges of the air gap insulator can be formed as tapered or angled surfaces, curved surfaces, a combination thereof, or the like, to smooth the flow of air over the air gap insulator and/or prevent a build-up of heat at these locations, for example due to stagnant air.

The present invention further provides a rear vent trim and rear wall assembly that is configured to control an angle of the air exiting the vent opening. An exemplary embodiment includes an oven vent trim having a deflector within an exit opening of the rear vent trim that optimizes and controls the flow of air exiting the rear vent trim from the vent opening such that the air flows in a predetermined direction, such as in a direction away from the back wall of the kitchen and above the top of the appliance, thereby minimizing or avoiding an impingement on the air flow through the rear vent trim, minimizing or avoiding a build-up of heat within the rear vent trim, and providing a smooth continuous flow of the air through the rear vent trim. The deflector is configured to minimize or prevent air from being reflected off of the back wall of the kitchen or other adjacent surfaces, or off of other surfaces of the appliance such that the air exhausting from the rear vent trim does not flow toward a user where it might possibly blow uncomfortable heated air against a user.

Other features and advantages of the present invention will become apparent to those skilled in the art upon review of the following detailed description and drawings.

BRIEF DESCRIPTION OF THE DRAWINGS

These and other aspects and features of embodiments of the present invention will be better understood after a reading of the following detailed description, together with the attached drawings, wherein.

DETAILED DESCRIPTION OF THE EXEMPLARY EMBODIMENTS OF THE INVENTION

Figure 1:
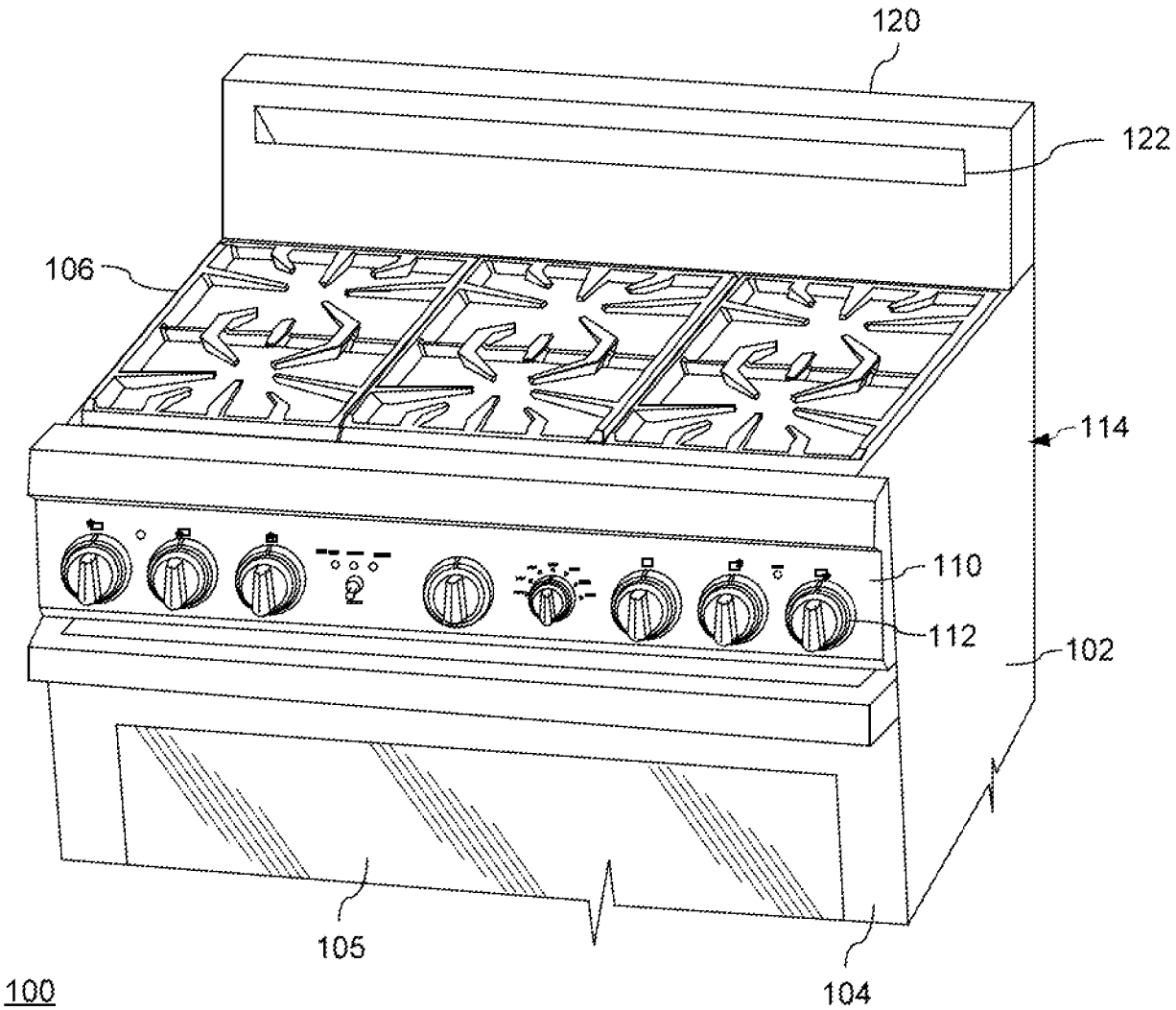
FIG. 1 is a partial, perspective view of a home cooking appliance according to an exemplary embodiment of the invention.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Referring now to the drawings, FIGS. 1-18 illustrate exemplary embodiments of a home cooking appliance having a rear vent trim, and more particularly, a home cooking appliance having a rear vent trim including an air gap insulator.

Figure 2:
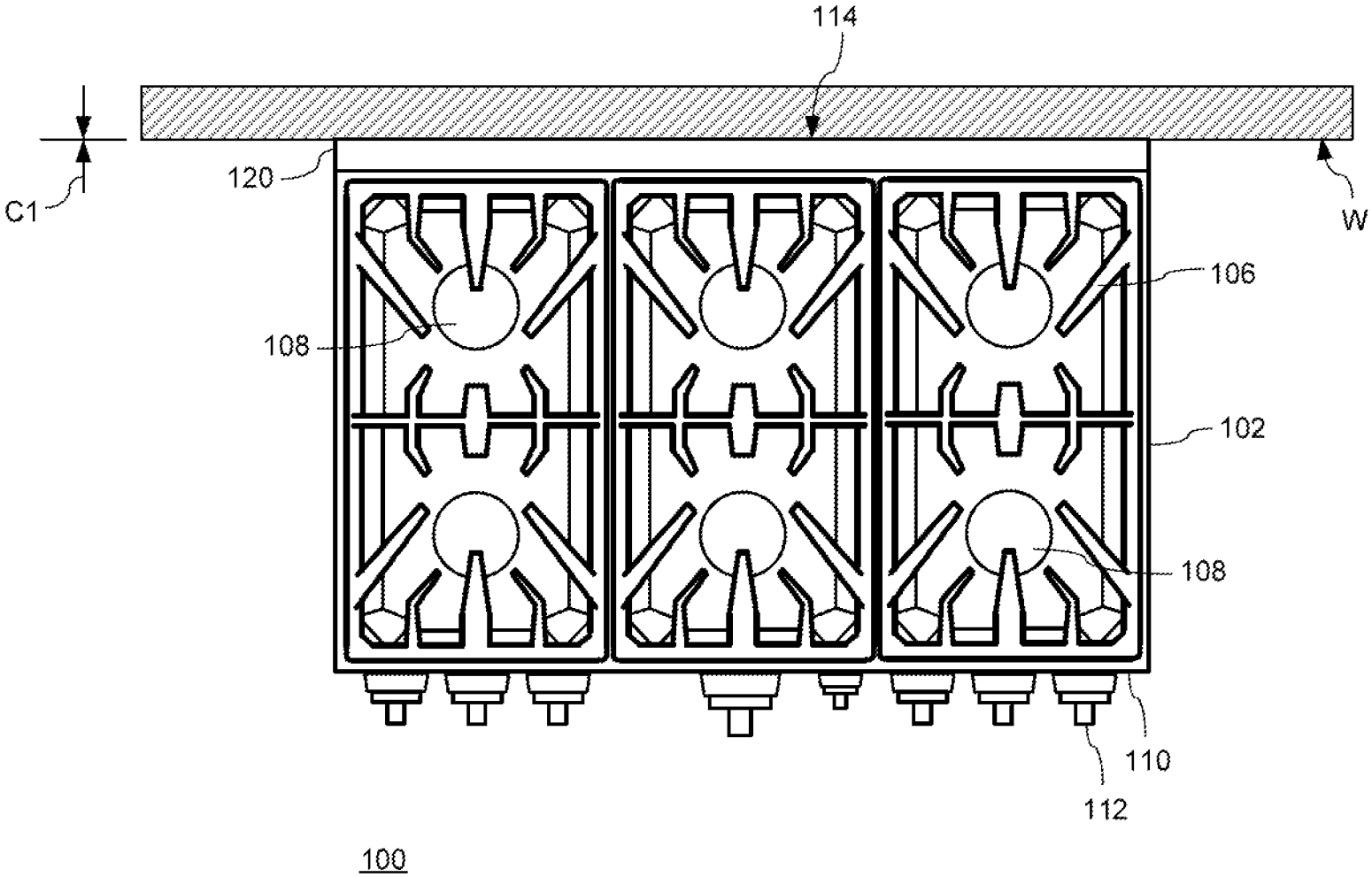
FIG. 2 is a top view of a home cooking appliance according to an exemplary embodiment of the invention.

With reference to FIGS. 1 and 2, an exemplary embodiment of a home cooking appliance 100, such as a Free Standing Range (FSR), will first be described. As shown in FIGS. 1 and 2, the home cooking appliance 100 may have a housing 102 with a cooking compartment, such as a baking oven, convection oven, steam oven, warming drawer, etc., in the housing 102 and accessible through a door 104 in a front of the housing 102. The door 104 can include a door glass 105 for viewing the interior of the cooking compartment. The home cooking appliance 100 has a cooking surface 106 on a top of the housing 102. The cooking surface 106 can include, for example, one or more cooking grates having an upper surface for supporting cookware over one or more gas burners 108. The appliance is not limited to the illustrated embodiment, and can additionally or alternatively include other cooking compartments, such as one or more baking ovens, convection ovens, steam ovens, warming drawers, broil burner, etc., or one or more cooking surfaces, such as a griddle, an induction cooktop with a glass ceramic cooking surface, etc. The appliance 100 includes a control panel 110 having a plurality of user input features, such as control knobs 112 for controlling the operation of the burners 108 and the cooking compartment.

The housing 102 can include a rear vent trim for exhausting air from within the appliance, such as hot flue gases from the oven compartment. The rear vent trim can take various forms depending on the particular appliance, arrangement of cooking compartment(s), cooktop or burners, desired aesthetics of the appliance, and/or the location in which the appliance will be installed, such as adjacent to a kitchen wall, in a kitchen island, adjacent to cabinetry or other accessories such as a fume hood, etc., among other things. For example, the rear vent trim can be configured to be raised up from the cooking surface by various amounts such as a high back, low back, high shelf, etc., or substantially flush with the top of the appliance or cooking surface. In the illustrated example, the housing 102 includes a rear vent trim 120 on the top of the housing 102 and at a rear side of the cooking surface 106. The rear vent trim 120 extends upward from the top of the appliance and includes a vent opening 122 for exhausting air from within the appliance, including flue gases from one or more oven flues. The rear vent trim 120 is configured to control and manage the flow of the exhausted air (e.g., hot air/flue gas) to minimize temperatures on a user and adjacent surfaces, such as surfaces of kitchen cabinetry adjacent to or above the appliance, surfaces of a combustible back wall (see W in FIG. 2) of the kitchen, etc. In this way, the rear vent trim can improve compliance of the appliance with industry standards and regulations and maintain passing combustion results at the gas burners 108, while also improving comfort of a user, for example, by minimizing a temperature of air flowing toward the user, minimizing noise to the user, etc.

As shown in FIG. 2, the appliance 100 can be configured to be positioned such that the rear wall 114 is close to a combustible surface, such as a back wall W of a kitchen. The temperature of the rear wall 114 of the appliance during operation of the appliance greatly affects a required minimum clearance C1 between the rear wall 114 of the appliance 100 and a combustible back wall W of the kitchen, which faces the rear wall 114 of the appliance, in order to minimize heat transfer from the rear wall 114 to the back wall W of the kitchen. The present invention recognizes that, during operation of the cooking compartment, heat from the hot flue gases being exhausted through the rear vent trim 120 can be transferred to the rear wall 114 of the appliance, thereby increasing a temperature of the rear wall 114 of the appliance, which may affect the required minimum clearance C1. The appliance 100 includes an air gap insulator, and more particularly a rear vent trim including an air gap insulator, which will be described in greater detail below with reference to FIGS. 3-12, and which is configured to reduce the amount of heat transferred from the oven exhaust vents to the rear wall 114 of the appliance or an accessory of the appliance, thereby limiting or reducing the temperature exposure to a back wall W of the kitchen to which the wall 114 of the appliance 100 is adjacent. The present invention can minimize or eliminate a required minimum clearance C1 between the rear wall 114 of the appliance 100 and a combustible back wall W of the kitchen, which faces the rear wall 114 of the appliance, while maintaining compliance with industry standards and regulations.

Figure 3:
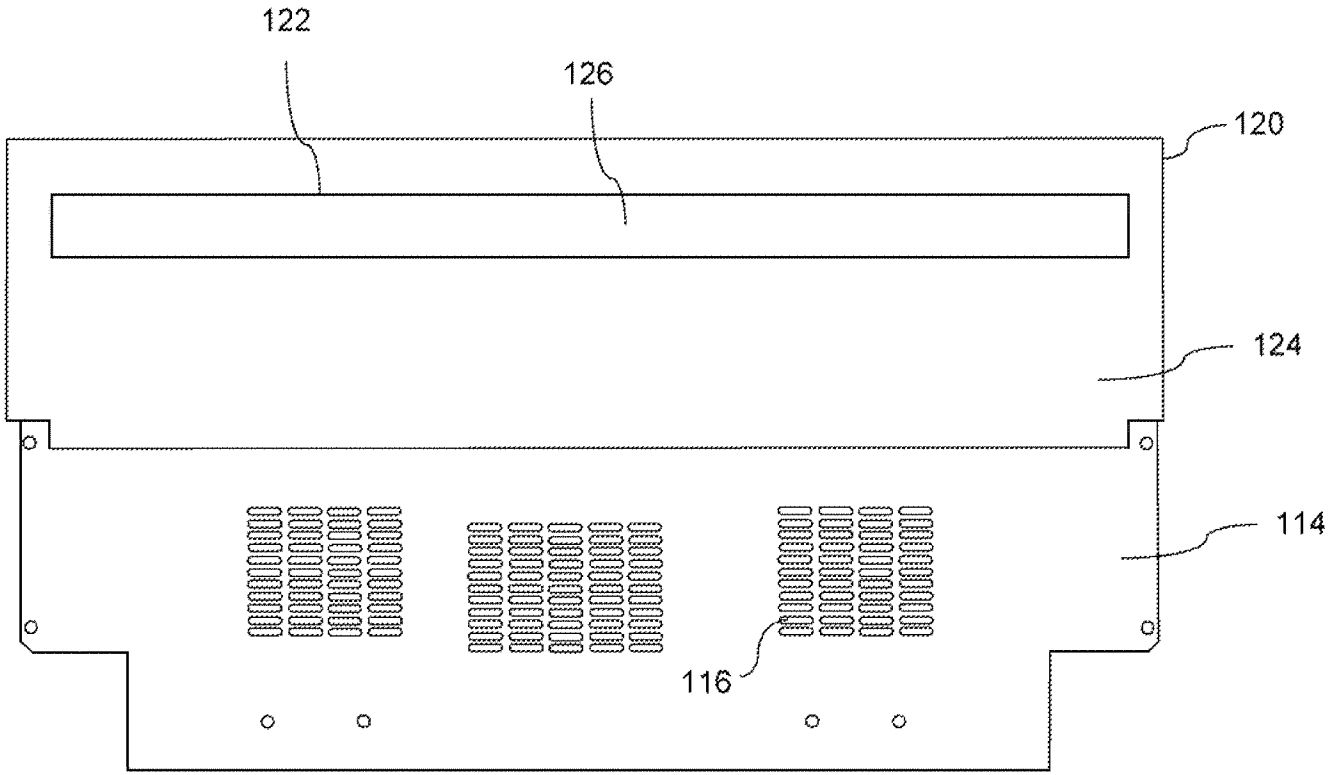
FIG. 3 is a front view of an oven vent trim and rear cover assembly of a home cooking appliance according to an exemplary embodiment of the invention.
Figure 4:
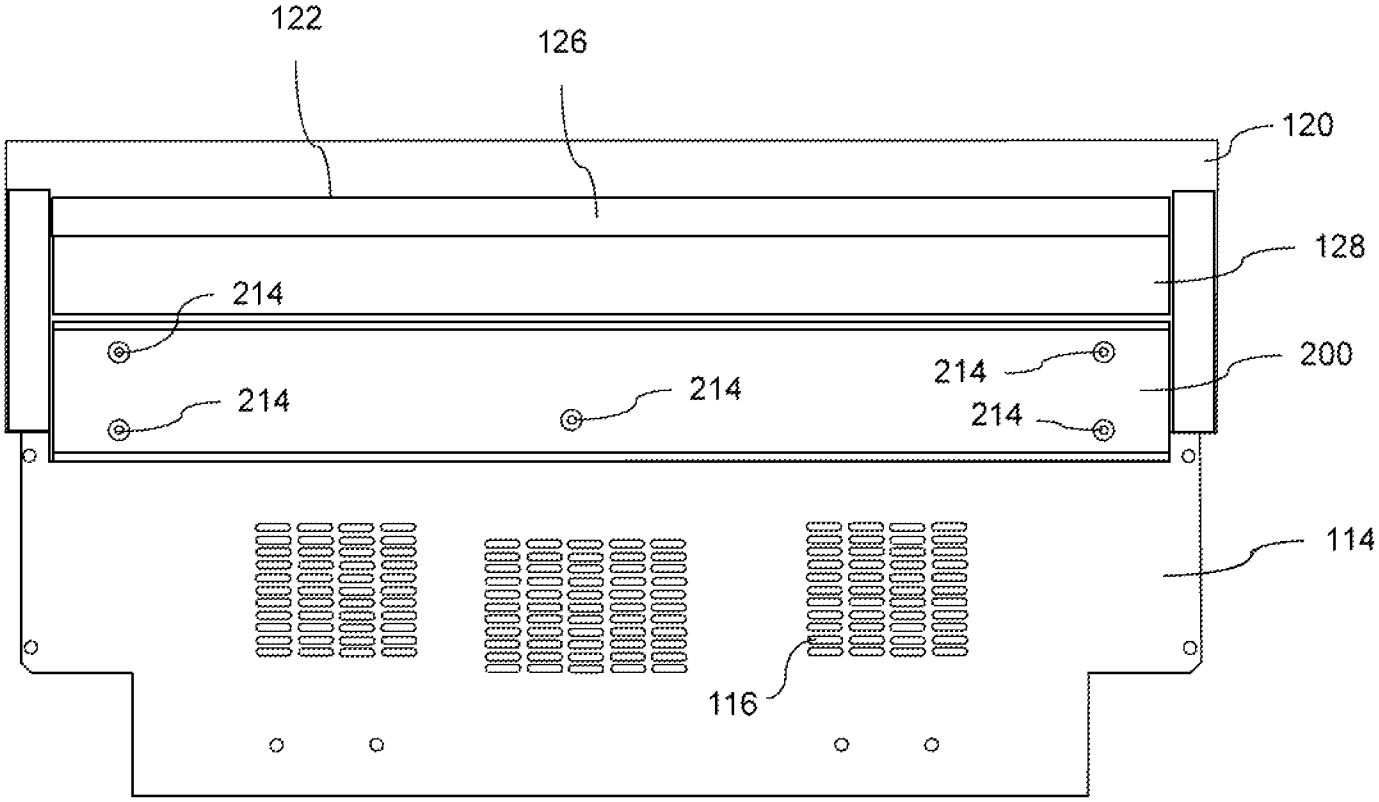
FIG. 4 is a cutaway, front view of an oven vent trim and rear cover assembly of a home cooking appliance according to an exemplary embodiment of the invention.
Figure 5:
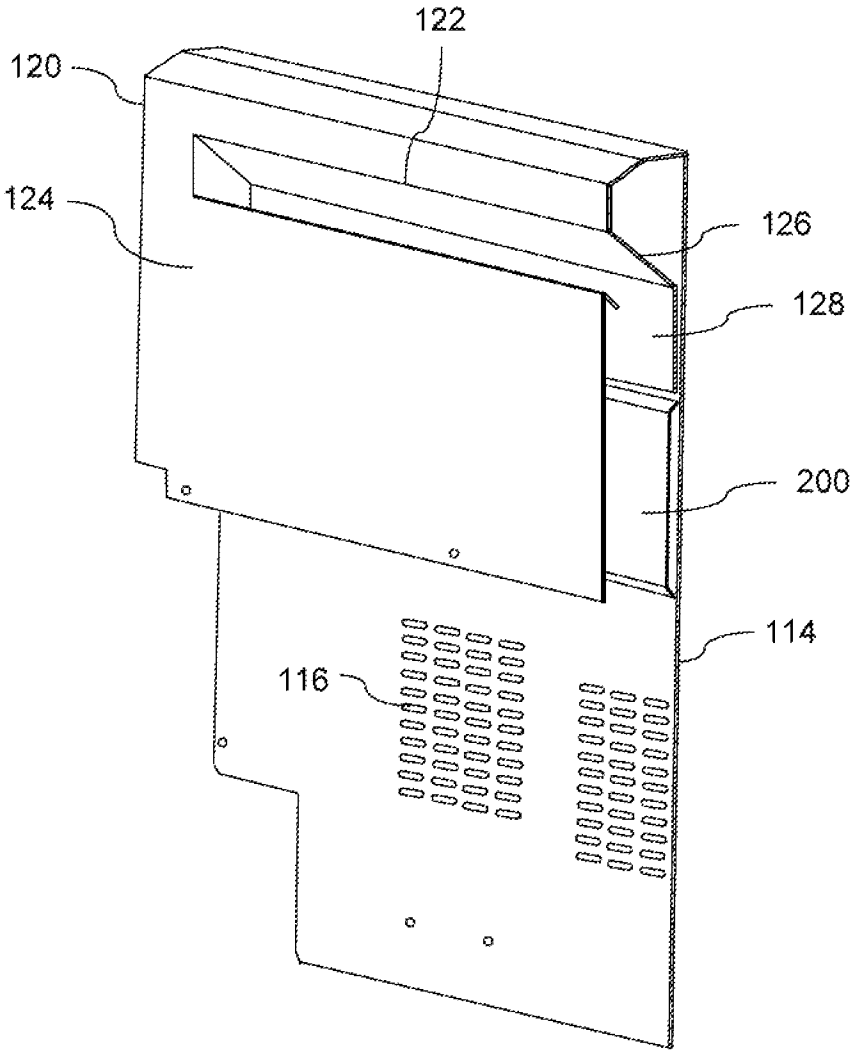
FIG. 5 is a cutaway, partial perspective view of an oven vent trim and rear cover assembly of a home cooking appliance according to an exemplary embodiment of the invention.
Figure 6:
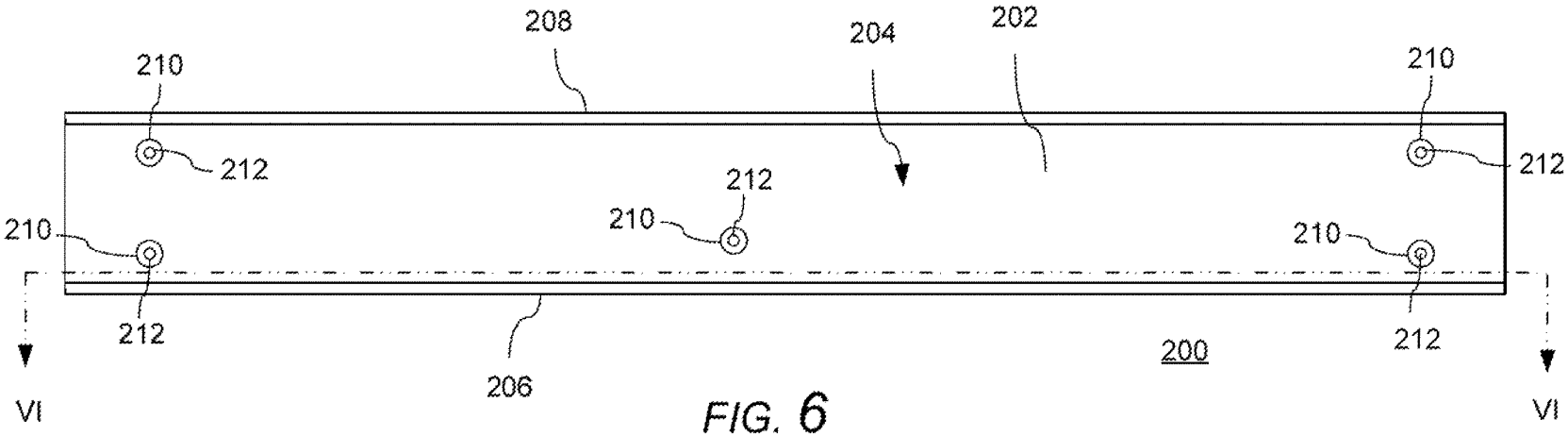
FIG. 6 is a front view of an air gap insulator of a home cooking appliance according to an exemplary embodiment of the invention.
Figure 7:
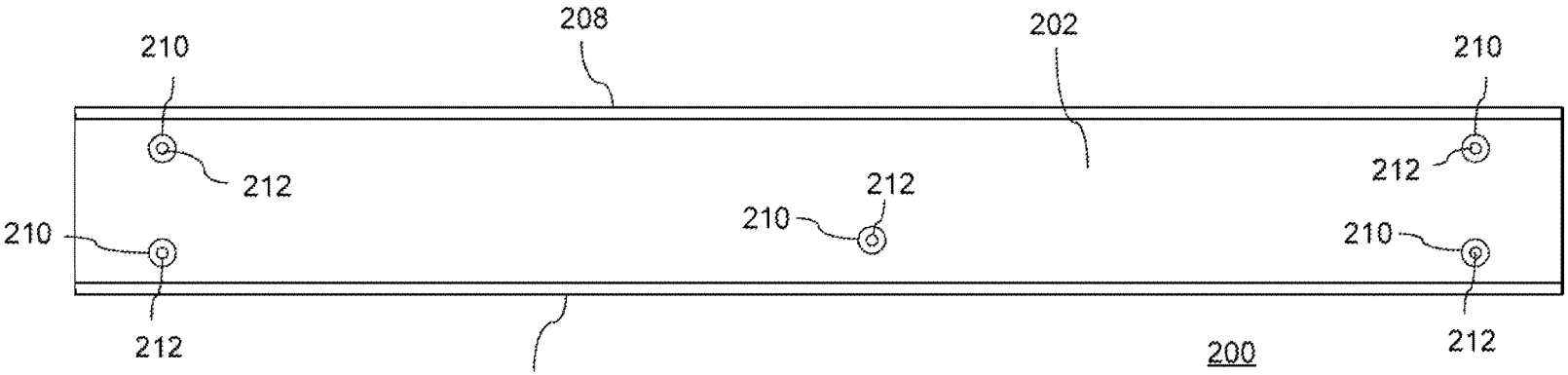
FIG. 7 is a rear view of the air gap insulator according to the exemplary embodiment illustrated in FIG. 6.

FIGS. 3-5 illustrate an oven vent trim and rear wall assembly of a home cooking appliance 100 according to an exemplary embodiment of the invention. As shown in FIG. 3, the oven vent trim 120 includes a front face 124 having an opening 122 for exhausting air, such as flue gases, from within the appliance. The oven vent trim 120 includes a deflector 126 within the opening 122 that is configured to deflect the air being exhausted from the appliance in a predetermined direction, such as, for example, in a direction away from the back wall of the kitchen and above the top of the appliance. The rear wall 114 can include one or more openings or vents 116 configured to permit air from outside the appliance to enter the housing of the appliance, for example, for cooling components and/or mixing with hot flue gases. The air vents 116 are illustrated as being positioned below the air gap insulator 200 in the example embodiment. In other embodiments, additionally or alternatively, one or more air vents 116 can be disposed in the portion of the rear wall 114 adjacent to or directly behind the air gap insulator 200, thereby permitting cooler outside air to be drawn directly into the air gap G.

FIG. 4 illustrates the oven vent trim and rear wall assembly with the front face 124 removed to illustrate the interior components. As shown in FIGS. 4 and 5, an air gap insulator 200 can be provided on an inner surface of the rear wall 114 at a location of an exhaust channel, which guides air from an oven flue (not shown) to the oven vent 122. In this example, the exhaust channel is formed between the inner surface of the front face 124 of the rear vent trim 120 and the rear wall 114 of the appliance. The air gap insulator 200 is configured to reduce the amount of heat that is transferred from the hot air, which is flowing from the oven flue through the exhaust channel, to the rear wall 114, thereby limiting or reducing a temperature of the rear wall 114 during operation of the oven, which in turn limits or reduces the temperature exposure to a back wall W of the kitchen to which the wall 114 of the appliance 100 is adjacent. The air gap insulator 200 can be positioned on a surface of the rear wall 114 (e.g., an inner surface of the rear wall 114) that is subject to temperature increases during operation of the appliance, such as a surface that is adjacent to or directly faces the exhaust channel from the oven flues. The location, size, and shape of the air gap insulator 200 can vary depending on the particular physical dimensions of one or more components of the appliance, such as an amount of available space between the flue fan exits and the deflector 126, the oven vent location(s), the number of oven vents or oven flues, the air flow through the exhaust channel, etc. In the illustrated example, the air gap insulator 200 is positioned on the rear wall 114 directly below a mounting flange 128 of the deflector 126. The air gap insulator 200 can directly abut the deflector 126, or a mounting flange 128 of the deflector 126, or be spaced from the deflector 126 or a mounting flange 128 of the deflector 126. The air gap insulator 200 can be positioned below the deflector 126 such that the air gap insulator 200 cannot be viewed readily by a user of the appliance through the opening of the oven vent 122. The air gap insulator 200 can be formed from a single part or from a plurality of parts. The air gap insulator 200 can be formed separately from other components of the appliance, or integrally formed with other components, such as the deflector 126, or a mounting flange 128 of the deflector 126. The arrangement, size, and shape of the air gap insulator 200 also can vary depending on the particular physical dimensions of one or more components of the appliance, the oven vent location(s), the number of oven vents or oven flues, the air flow through the exhaust channel, etc.

With reference to FIGS. 6-11, an exemplary embodiment of an air gap insulator 200 will now be described.

The air gap insulator 200 includes a plate portion 202 having a surface 204 arranged to be exposed (e.g., directly exposed) to flue gases (e.g., air A1 in FIG. 11) flowing through an exhaust channel (e.g., 300 in FIG. 11) from an oven flue (not shown) to the oven vent 122. The plate portion 202 can be arranged to be parallel to the flow of air A1 in the exhaust channel. The air gap insulator 200 can include a first flange 206 on an upstream side of the plate portion 202 configured to guide the flow of flue gases over the plate portion 202. The air gap insulator 200 can include a second flange 208 on a downstream side of the plate portion 202 configured to guide the flow of flue gases from the plate portion 202. The first flange 206 and the second flange 208 can be formed as tapered or angled surfaces, curved surfaces, a combination thereof, or the like, to smooth the flow of air A1 over the air gap insulator 200 and/or prevent a build-up of heat at these locations, for example due to stagnant air. For example, the first flange 206 and/or the second flange 208 can be tapered or angled by substantially 45°. The first flange 206 and the second flange 208 can be tapered by the same amount or a different amount. The air gap insulator 200 can include one or more elements for mounting the air gap insulator 200 to the rear wall 114, or another component. For example, as shown in FIGS. 6, 7, and 9-11, the air gap insulator 200 can include one or more openings 212 configured to receive a fixation device, such as a rivet (e.g., 214 in FIGS. 11-13), screw, weld, adhesive, or the like. The air gap insulator 200 can include one or more embosses 210 at each opening 212 such that a part of the fixation device, such as a head of a rivet, screw, or the like, can be recessed partly or entirely below the surface 204 to avoid interference with the flow of air A1 over the surface 204. The one or more openings 212 and/or the one or more embosses 210 can have a unique arrangement (e.g., non-symmetrical) that permits installation and assembly of the air gap insulator 200 on the rear wall 114 in only a single possible position, thereby insuring that the air gap insulator can only be installed in the correct position.

Figure 8:
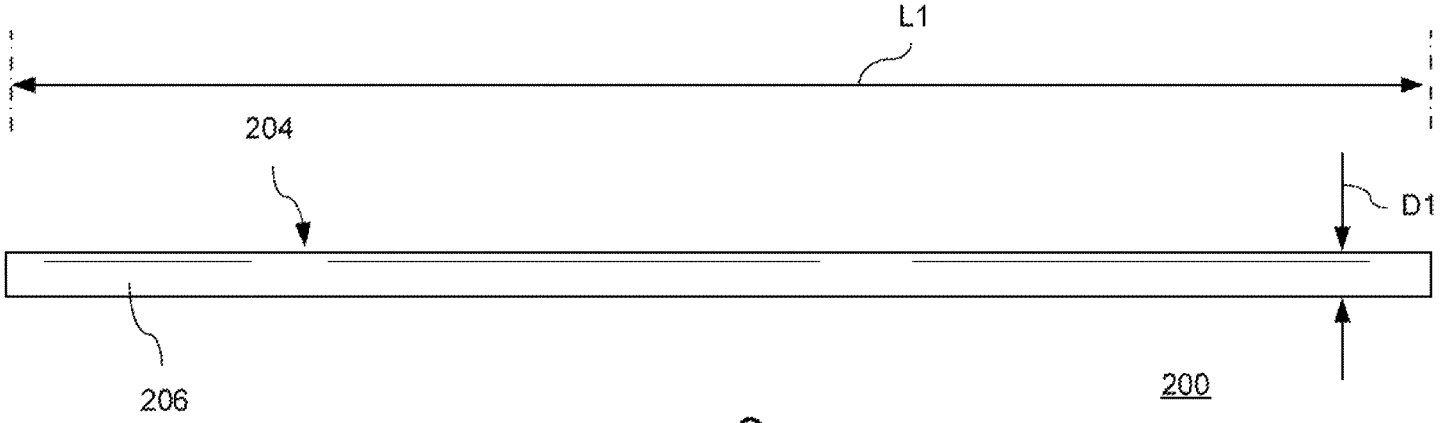
FIG. 8 is a side view of an air gap insulator, viewed from an upstream side, according to the exemplary embodiment illustrated in FIG. 6.
Figure 9:
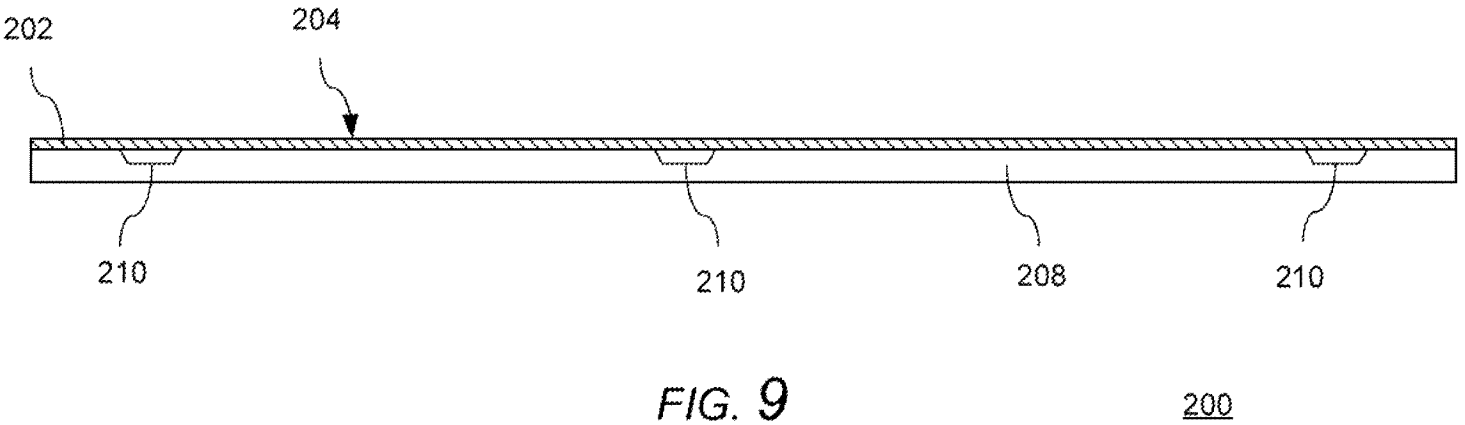
FIG. 9 is a cross-sectional, side view of the air gap insulator taken along section VI-VI in FIG. 6.
Figure 10:
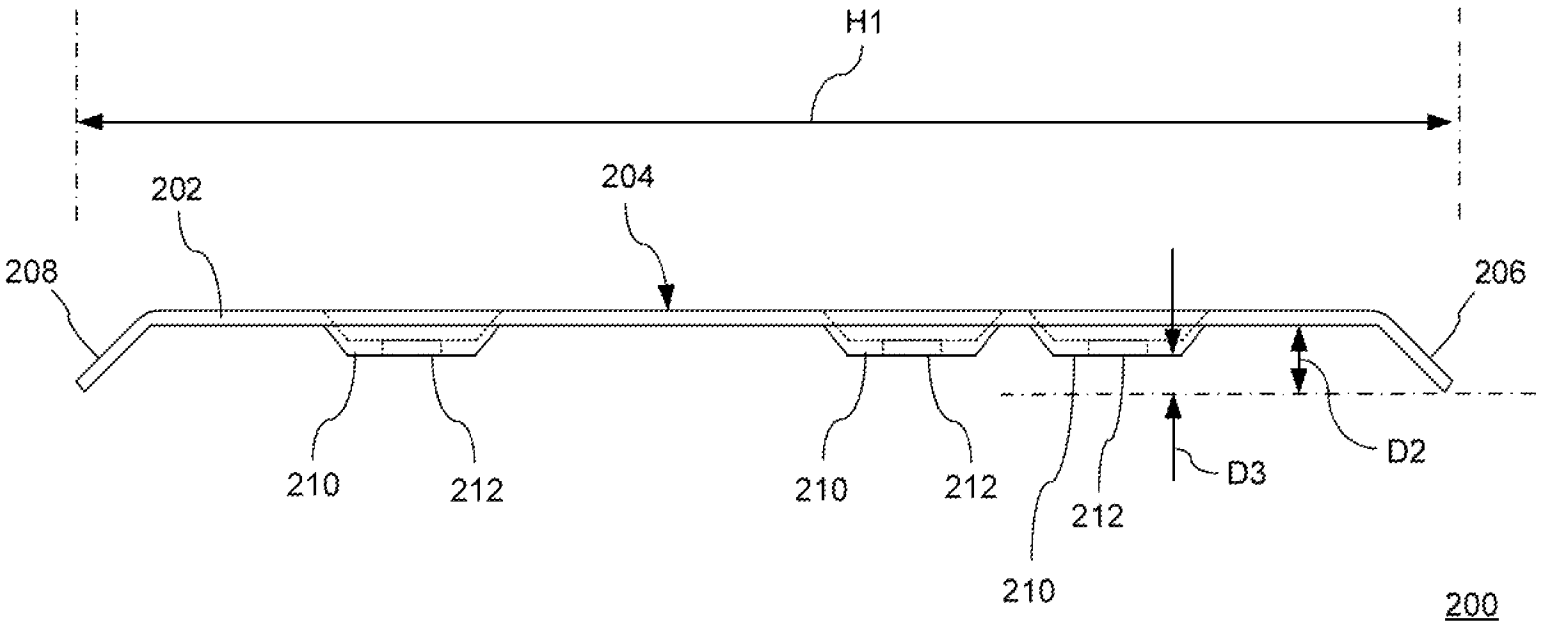
FIG. 10 is an end view of the air gap insulator according to the exemplary embodiment illustrated in FIG. 6.

As shown in FIG. 8, the air gap insulator 200 has a depth D1 in a direction perpendicular to the flow of air A1 in the exhaust channel and perpendicular to the rear wall 114, and a length L1 in a direction perpendicular to the flow of air A1 in the exhaust channel and parallel to the rear wall. As shown in FIG. 10, the air gap insulator 200 has a height H1 in a direction parallel to the flow of air A1 in the exhaust channel.

Figure 11:
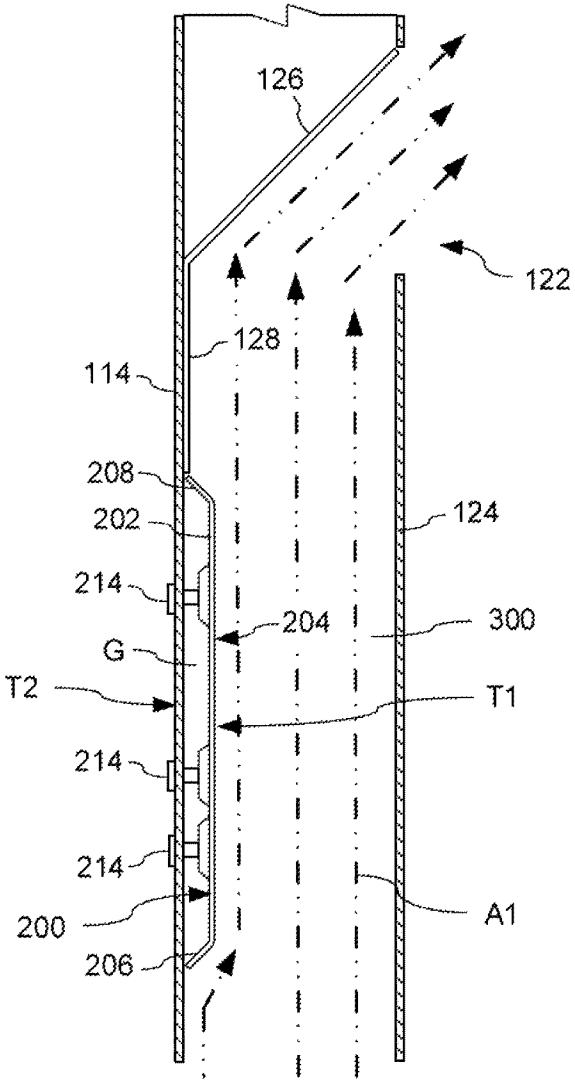
FIG. 11 is a cut-away end view of an oven vent trim and rear cover assembly of a home cooking appliance according to an exemplary embodiment of the invention.

With reference to FIGS. 10 and 11, the air gap insulator 200 can be mounted to the rear wall 114 and configured to form an air gap G between the air gap insulator 200 and an inner surface of the rear wall 116 of the appliance, and more particularly, between the plate portion 202 of the air gap insulator 200 and the rear wall 114. In an assembled position, the air gap G has a depth D2 defined by the space between the plate portion 202 and the rear wall 114. The air gap G can reduce the amount of heat that is transferred from the air gap insulator 200 (which is heated by the hot air A1 that flows from the oven flue through the exhaust channel) to the rear wall 114. As a result, during operation of the appliance, a temperature T2 of the rear wall 114 is less than a temperature T1 of the air gap insulator 200, which in turn limits or reduces the temperature exposure to a back wall W of the kitchen to which the wall 114 of the appliance 100 is adjacent. The depth D2 of the air gap insulator 200 can vary depending on the particular physical dimensions of one or more components of the appliance, the oven vent location(s), the number of oven vents or oven flues, the air flow through the exhaust channel, etc.

As shown in FIGS. 10 and 11, the air gap insulator 200 can be mounted to have minimal or limited contact with the rear wall 114 to minimize heat transfer from the air gap insulator 200 to the rear wall 114. For example, the one or more embosses 210 can be spaced from the rear wall 114 by a depth D3 defined by the space between the rear wall 114 and a surface of the emboss 210 facing the rear wall 114. As a result, the heat transfer from one solid to another solid (e.g., metal to metal) can be substantially limited to heat transfer through the one or more fixation devices, such as rivets, screws, or the like.

Figure 12:
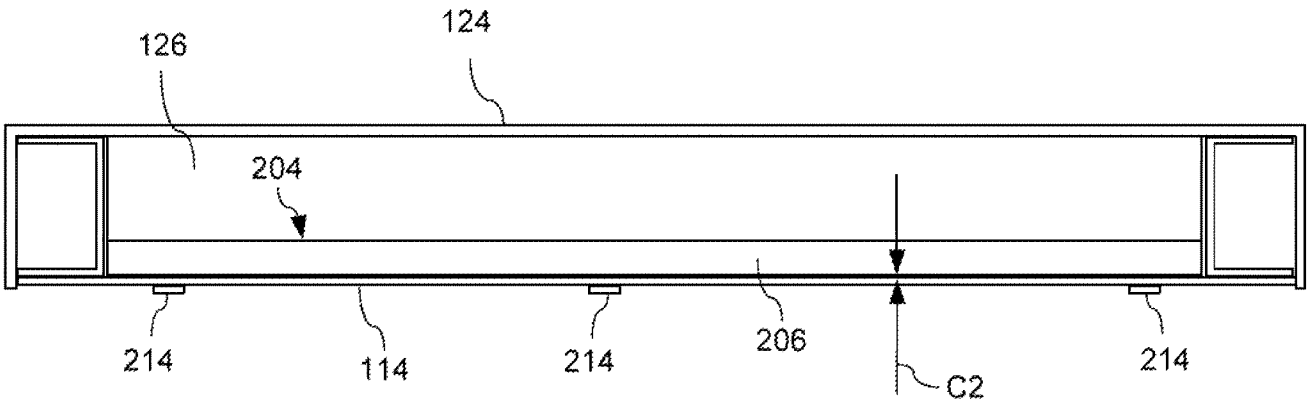
FIG. 12 is a side view of an oven vent trim and rear cover assembly, viewed from an upstream side, according to an exemplary embodiment of the invention.

As shown in FIGS. 11 and 12, the first flange 206 and second flange 208 can be configured to substantially close off the air gap G from the air A1 flowing in the exhaust channel 300, thereby minimizing or preventing hot air A1 from the exhaust channel from directly contacting the surface of the rear wall 114 adjacent to the air gap G. The arrangement of the first and second flanges 206 and 208 may result in a pressure difference between the air gap G and the exhaust channel, and particularly, a lower pressure in the air gap G than in the exhaust channel. To minimize heat transfer from the first flange 206 and the second flange 208 to the rear wall 114, the first flange 206 and the second flange 208 can be arranged to loosely contact the rear wall 114, or to be spaced by a minimal amount or clearance C2 from the rear wall 114, as shown in FIGS. 11 and 12. Such minimal spacing or clearance C2 between the first flange 206 and the second flange 208 and the rear wall 114 can permit air (e.g., small amounts of air) to be drawn into the low pressure area of the air gap, for example, from the openings 116 in the rear wall 114, which may provide some cooling of the air gap insulator 200 and/or generate a flow of cooler air within the air gap G, which may limit or reduce heat transfer from the air gap insulator 200 to the rear wall 114. Moreover, the heat transfer from one solid to another solid (e.g., metal to metal) can be substantially limited or reduced. This arrangement also may limit or reduce an amount of heat that is dispersed or conducted through the rear wall 114 to other portions of the rear wall 114, other than the particular location of the air gap insulator 200. This arrangement of the air gap insulator 200 may also minimize or prevent a build-up of heat along the edge of the first flange 206. One of ordinary skill in the art will recognize that, in some embodiments, the edge of each of the first or second flanges 206, 208 does not need to contact the rear wall 114 along its entire length, or alternatively, does not need to be separated from the rear wall 114 along its entire length. In some exemplary embodiments, in practice, some contact (e.g., incidental contact) between the edge of each of the first or second flanges 206, 208 and the rear wall 114 is possible within the spirit and scope of the invention.

Figure 13:
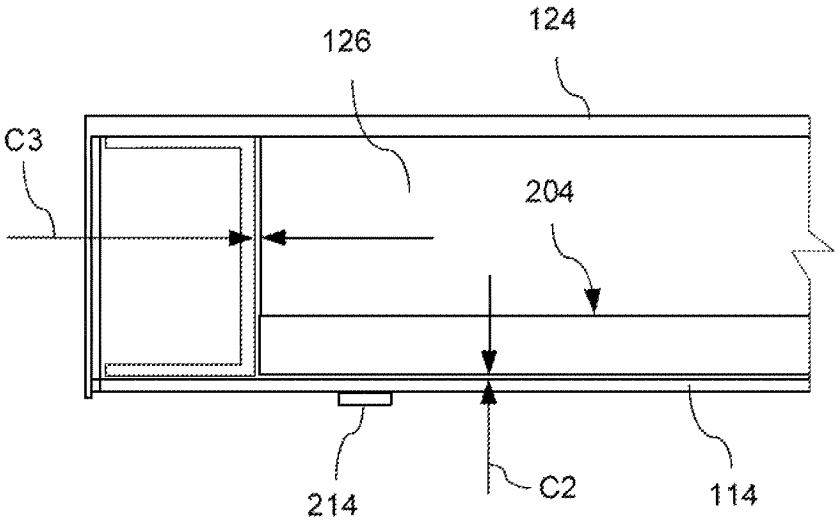
FIG. 13 is a partial, side view of the oven vent trim and rear cover assembly according to the exemplary embodiment illustrated in FIG. 12.

As shown in FIGS. 12 and 13, to minimize heat transfer from one or both ends of the air gap insulator 200, the air gap insulator 200 can be arranged to loosely contact any adjacent surfaces, or to be spaced by a minimal amount or clearance C3 from any adjacent surfaces. Such minimal spacing or clearance C3 between one or both ends of the air gap insulator 200 and any adjacent surfaces can permit air (e.g., small amounts of air) to be drawn into the low pressure area of the air gap G, for example, from the openings 116 in the rear wall 114, which may provide some cooling of the air gap insulator 200 and/or generate a flow of cooler air within the air gap G, which may limit or reduce heat transfer from the air gap insulator 200 to the rear wall 114. Moreover, the heat transfer from one solid to another solid (e.g., metal to metal) can be substantially limited or reduced.

Figure 14:
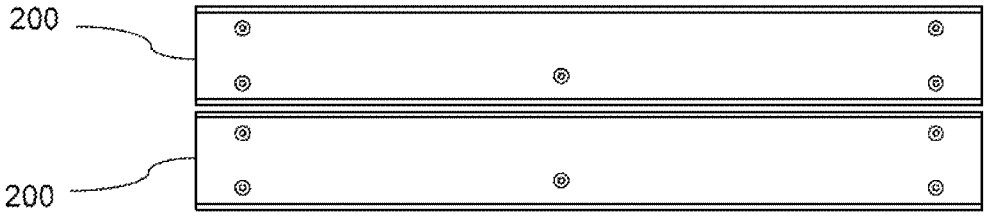
FIG. 14 is a front view of a plurality of air gap insulators of a home cooking appliance according to another exemplary embodiment of the invention.

As mentioned above, the arrangement, size, and shape of the air gap insulator 200 can vary depending on the particular physical dimensions of one or more components of the appliance, the oven vent location(s), the number of oven vents or oven flues, the air flow through the exhaust channel, etc. For example, as shown in FIG. 14, one or more air gap insulators can be provided. One or more air gap insulators can be arranged in series in a direction along the flow path of the air A1 through the exhaust channel, and/or in series in a direction transverse to the flow path of the air A1 through the exhaust channel and parallel to the rear wall 114. The air gap insulators can be spaced from each other, or substantially or directly abut each other. One or more air gap insulators can be arranged to reduce a temperature of the rear wall 114 by different amounts at different locations, for example, to account for hot spots that otherwise may result on the rear wall 114, such as areas closer to the oven flues or areas where temperatures are increased due to other factors.

Figure 15:
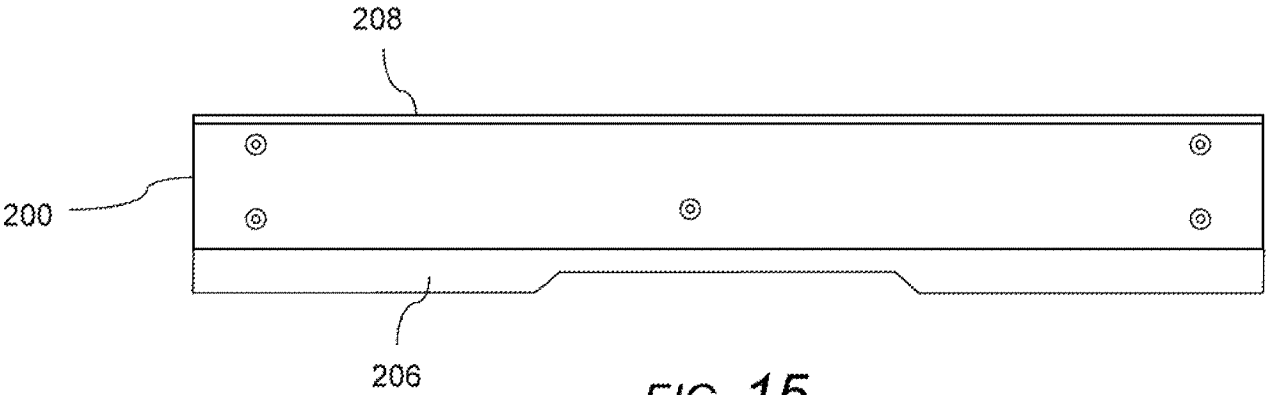
FIG. 15 is a front view of an air gap insulator of a home cooking appliance according to another exemplary embodiment of the invention.

A height H1 (in a direction parallel to the flow of air A1 in the exhaust channel, as shown in FIG. 10) of the air gap insulator can be substantially the same across a length L1 (in a direction perpendicular to the flow of air A1 in the exhaust channel and parallel to the rear wall as shown in FIG. 8) of the air gap insulator, as shown in FIG. 10, or the height H1 of the air gap insulator can vary along a length L1 of the air gap insulator, or at various locations along the length L1, as shown in FIG. 15.

Figure 16:
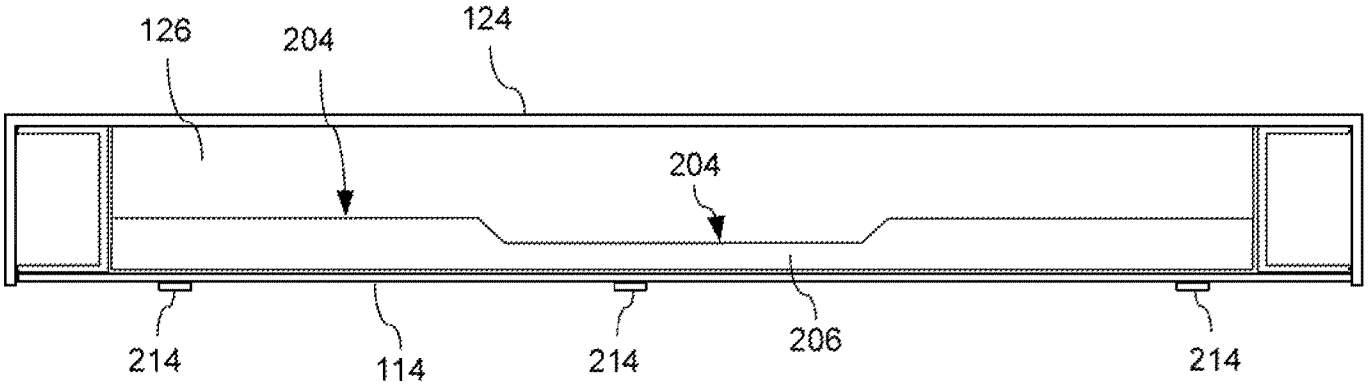
FIG. 16 is a side view of an oven vent trim and rear cover assembly, viewed from an upstream side, according to an exemplary embodiment of the invention.

A depth D1 (in a direction perpendicular to the flow of air A1 in the exhaust channel and perpendicular to the rear wall as shown in FIG. 8) of the air gap insulator can be substantially the same across a length L1 (in a direction perpendicular to the flow of air A1 in the exhaust channel and parallel to the rear wall as shown in FIG. 8) of the air gap insulator as shown in FIG. 12, or the depth D1 of the air gap insulator can vary along a length L1 of the air gap insulator, or at various locations along the length L1, as shown in FIG. 16. Additionally or alternatively, a depth D1 of the air gap insulator can be substantially the same along a height H1 (as shown in FIG. 10) of the air gap insulator as shown in FIG.

Figure 17:
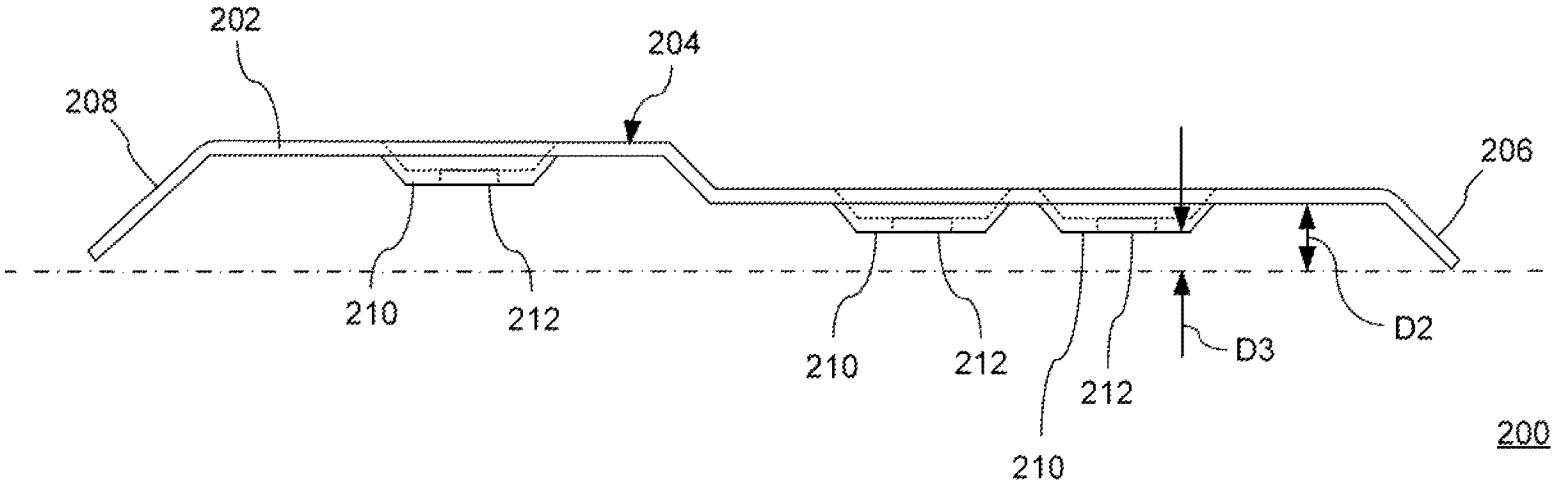
FIG. 17 is an end view of an air gap insulator, according to another exemplary embodiment of the invention.

10, or the depth D1 of the air gap insulator can vary along a height H1 of the air gap insulator or at various locations along the height H1, as shown in FIG. 17.

A depth D2 of the air gap (in a direction perpendicular to the flow of air A1 in the exhaust channel and perpendicular to the rear wall as shown in FIG. 8), can be substantially the same across a length L1 of the air gap insulator (in a direction perpendicular to the flow of air A1 in the exhaust channel and parallel to the rear wall as shown in FIG. 8) as shown in FIG. 10, or the depth D2 of the air gap can vary along a length L1 of the air gap insulator, or at various locations along the length L1, as shown in FIG. 16. Additionally or alternatively, a depth D2 of the air gap can be substantially the same along a height H1 of the air gap insulator (as shown in FIG. 10) as shown in FIG. 10, or the depth D2 of the air gap can vary along a height H1 of the air gap insulator, or at various locations along the height H1, as shown in FIG. 17.

A depth D3 at the embosses 210 of the air gap insulator (in a direction perpendicular to the flow of air A1 in the exhaust channel and perpendicular to the rear wall as shown in FIG. 10), can be substantially the same across a length L1 of the air gap insulator (in a direction perpendicular to the flow of air A1 in the exhaust channel and parallel to the rear wall as shown in FIG. 8) as shown in FIG. 10, or the depth D3 at the embosses 210 of the air gap insulator can vary along a height H1 or length L1 of the air gap insulator, or at various locations along the height H1 or length L1, as shown in FIG. 17.

One or more air gap insulators can be arranged to be stacked with another air gap insulator or to overlap another air gap insulator, for example, to vary the effective height, length, or depth of the air gap insulators, or to vary the height, length, or depth at a particular location, such as a hot spot.

The plate portion 202 can be configured to be parallel (or substantially parallel) to the rear wall 114. In other exemplary embodiments, the plate portion 202 can be configured to be at an angle with respect to the rear wall 114, in a direction along the length L1 of the air gap insulator (in a direction perpendicular to the flow of air A1 in the exhaust channel and parallel to the rear wall as shown in FIG. 8) and/or in a direction of the height H1 of the air gap insulator (in a direction parallel to the flow of air A1 in the exhaust channel, as shown in FIG. 10).

Figure 18:
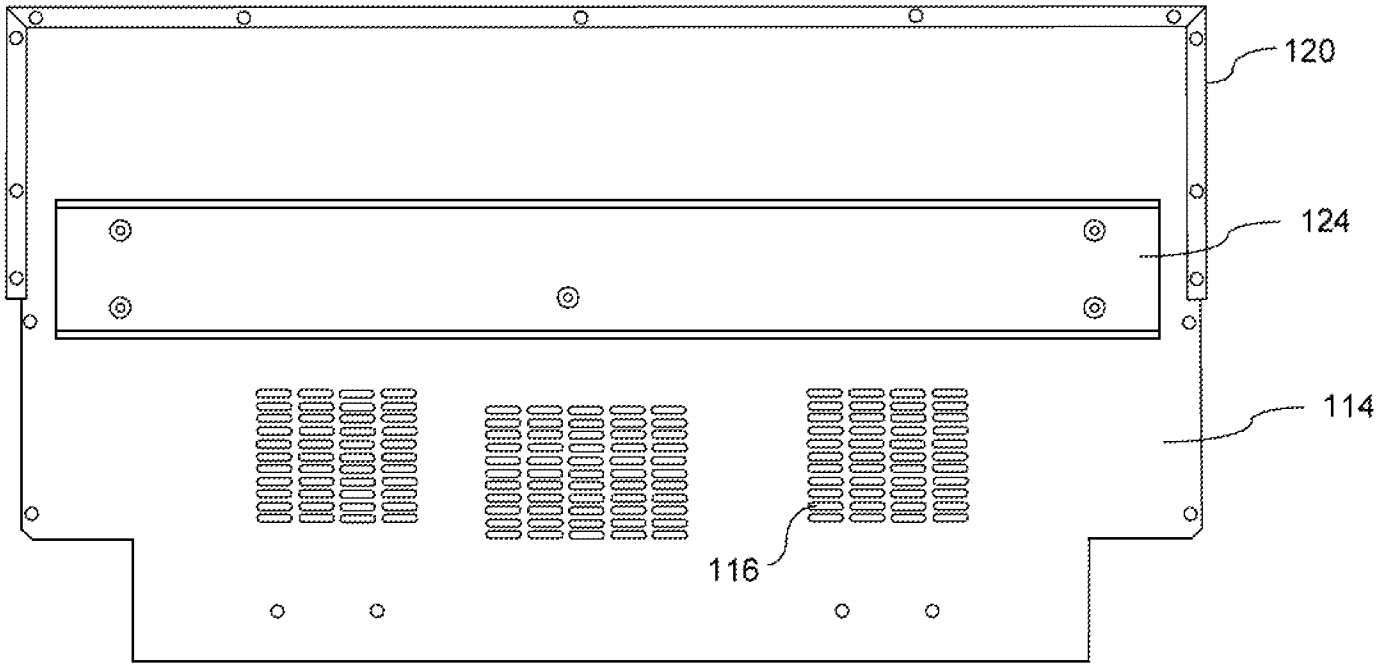
FIG. 18 is a rear view of an oven vent trim and rear cover assembly of a home cooking appliance according to another exemplary embodiment of the invention.

As shown in another exemplary embodiment illustrated in FIG. 18, an air gap insulator 200 can be mounted to an exterior surface of the rear wall 114. In this example, the air A1 in the exhaust channel may directly contact the inner surface of the rear wall 114. The air gap insulator 200 can be mounted to the rear wall 114 and configured to form an air gap G between the air gap insulator 200 and an outer surface of the rear wall 116 of the appliance, and more particularly, between the plate portion 202 of the air gap insulator 200 and the outer surface of the rear wall 114. In an assembled position, the air gap can reduce the amount of heat that is transferred from the rear wall 114 (which is heated by the hot air A1 that flows from the oven flue through the exhaust channel) to the surface 204 of the air gap insulator 200. As a result, during operation of the appliance, a temperature at the air gap insulator 200 may be less than a temperature of the rear wall 114 in that location, which may in turn limit or reduce the temperature exposure to a back wall W of the kitchen to which the appliance 100 is adjacent. One of ordinary skill will recognize that this arrangement may not limit or reduce an amount of heat, for example, that is dispersed or conducted through the rear wall 114 to other portions of the rear wall 114, away from the particular location of the air gap insulator 200, as much as is possible with an embodiment in which the air gap insulator 200 is on an inner side of the rear wall 114.

The present invention has been described herein in terms of several preferred embodiments. However, modifications and additions to these embodiments will become apparent to those of ordinary skill in the art upon a reading of the foregoing description. It is intended that all such modifications and additions comprise a part of the present invention to the extent that they fall within the scope of the several claims appended hereto.

What is claimed is:

1. A home cooking appliance comprising:
a housing having a rear wall;
a cooking compartment in the housing;
an exhaust channel that exhausts air from the cooking compartment; and
an air gap insulator disposed in the exhaust channel between the rear wall and the air flowing in the exhaust channel and forming an air gap between the rear wall and the exhaust channel.

2. The home cooking appliance of claim 1, further comprising:
a cooking surface on a top of the housing;
a rear vent trim on the top of the housing and at a rear side of the top of the housing, the rear vent trim having an opening in communication with the exhaust channel for permitting the air to exhaust from the housing.

3. The home cooking appliance of claim 1, wherein the air gap insulator is configured to reduce an amount of heat transferred from the air in the exhaust channel to the rear wall.

4. The home cooking appliance of claim 1, wherein the opening of the rear vent trim is formed in a front face of the rear vent trim.

5. The home cooking appliance of claim 1, wherein the oven vent trim includes a deflector within the opening, the deflector configured to deflect the air being exhausted from the appliance in a predetermined direction.

6. The home cooking appliance of claim 5, wherein the air gap insulator is positioned upstream of the deflector in the exhaust channel.

7. The home cooking appliance of claim 1, wherein the air gap insulator is positioned on a surface of the rear wall that faces the exhaust channel.

8. The home cooking appliance of claim 1, wherein the air gap insulator includes a plate portion having a surface arranged to be exposed to the air in the exhaust channel.

9. The home cooking appliance of claim 8, wherein the plate portion is configured to be parallel to a flow of the air in the exhaust channel.

10. The home cooking appliance of claim 8, wherein the air gap insulator includes:
a first flange on an upstream side of the plate portion, the first flange configured to guide the air over the plate portion.

11. The home cooking appliance of claim 10, wherein the air gap insulator includes:
a second flange on a downstream side of the plate portion, the second flange configured to guide the air over the plate portion.

12. The home cooking appliance of claim 10, wherein the first flange includes a surface that is angled with respect to the plate portion.

13. The home cooking appliance of claim 10, wherein the first flange extends in a direction other than 90° from the plate portion toward the rear wall.

14. The home cooking appliance of claim 10, wherein the first flange includes a surface that is curved with respect to the plate portion.

15. The home cooking appliance of claim 11, wherein each of the first flange and the second flange is angled in a direction other than 90° from the plate portion toward the rear wall.

16. The home cooking appliance of claim 15, wherein an angle of the first flange with respect to the plate portion is substantially equal to an angle of the second flange with respect to the plate portion.

17. The home cooking appliance of claim 15, wherein an angle of the first flange with respect to the plate portion is different than an angle of the second flange with respect to the plate portion.

18. The home cooking appliance of claim 8, wherein the air gap insulator includes an element for mounting the air gap insulator to the rear wall without direct physical contact between the plate portion and the rear wall.

19. The home cooking appliance of claim 11, wherein the air gap insulator includes an element mounting the air gap insulator to the rear wall without direct physical contact between the plate portion and the rear wall.

20. The home cooking appliance of claim 18, wherein the plate portion includes an emboss that receives a part of the element, and wherein a surface of the emboss facing the rear wall is spaced from the rear wall.

21. The home cooking appliance of claim 1, wherein the air gap insulator includes:

a plate portion having a surface facing an interior of the exhaust channel and arranged to be exposed to the air in the exhaust channel;

a first flange on an upstream side of the plate portion; and a second flange on a downstream side of the plate portion, wherein the plate portion, the first flange, and the second flange cooperate with the rear wall to form the air gap between the rear wall and the exhaust channel, and wherein the plate portion, the first flange, and the second flange substantially close off the air gap from the air in the exhaust channel.

22. The home cooking appliance of claim 21, wherein an edge of an upstream end of the first flange is spaced from the rear wall, and wherein an edge of a downstream end of the second flange is spaced from the rear wall.

23. The home cooking appliance of claim 21, wherein an edge of the air gap insulator extending in a direction parallel to a flow of the air in the exhaust channel is spaced from other components of the appliance.

24. A home cooking appliance comprising:

a housing having a rear wall;

a cooking compartment in the housing;

an exhaust channel that exhausts air from the cooking compartment; and an air gap insulator mounted on the rear wall of the housing, wherein the air gap insulator includes:

a plate portion configured to be parallel to a portion of the rear wall upon which the air gap insulator is mounted and forming an air gap between the air gap insulator and the portion of the rear wall;

a first flange on an upstream side of the plate portion, the first flange including a surface that extends at an angle from the upstream side of the plate portion towards the portion of the rear wall and terminates at a first edge facing the rear wall and spaced from the rear wall;

a second flange on a downstream side of the plate portion, the second flange including a surface that extends at an angle from the downstream side of the plate portion to the portion of the rear wall and terminates at a second edge facing the rear wall and spaced from the rear wall; and an element for mounting the air gap insulator on the rear wall without direct physical contact between the air gap insulator and the rear wall, the element including a first end mounted to a surface of the air gap insulator that faces the rear wall and a second end mounted on the portion of the rear wall, wherein the plate portion, the first flange, and the second flange cooperate with the portion of the rear wall to form the air gap, and the element is disposed in the air gap and arranged between the first edge of the first flange and the second edge of the second flange.

25. The home cooking appliance of claim 24, wherein the air gap insulator substantially closes off the air gap from the air in the exhaust channel.

26. The home cooking appliance of claim 1, wherein the air gap insulator includes a plate portion having a surface exposed to the air from the cooking compartment flowing through the exhaust channel.

27. The home cooking appliance of claim 1, wherein the exhaust channel includes a front surface and a rear surface defining a flow path along which the air flows through the exhaust channel, and wherein the rear surface is formed at least in part by the rear wall of the appliance and at least in part by the plate portion of the air gap insulator.

28. The home cooking appliance of claim 1, wherein the air gap insulator is mounted to the rear wall of the housing by at least one fixation device having a first end mounted to the air gap insulator and a second end mounted to the rear wall.

29. The home cooking appliance of claim 1, further comprising:

a second air gap insulator disposed in the exhaust channel, the second air gap insulator forming a second air gap between the rear wall and the air flowing in the exhaust channel.

30. The home cooking appliance of claim 29, wherein the first air gap insulator is spaced apart from the second air gap insulator on the rear wall.

31. The home cooking appliance of claim 29, wherein the first air gap insulator abuts the second air gap insulator on the rear wall.

32. A home cooking appliance comprising:

a housing having a rear wall;

a cooking compartment in the housing;

an exhaust channel that exhausts air from the cooking compartment; and an air gap insulator mounted to the rear wall of the housing, the air gap insulator including a plate portion forming an air gap between the air gap insulator and the rear wall, wherein the air gap insulator is mounted to an interior surface of the rear wall of the housing and the air gap is formed between the plate portion and the interior surface of the rear wall of the housing, and wherein the air gap insulator is disposed in the exhaust channel and the plate portion includes a surface exposed to the air from the cooking compartment flowing through the exhaust channel.

33. The home cooking appliance of claim 24, wherein the air gap insulator is mounted on an exterior surface of the rear wall of the housing and the air gap is formed between the plate portion and a portion of the exterior surface of the rear wall of the housing upon which the air gap insulator is mounted.

34. The home cooking appliance of claim 24, wherein the air gap insulator is mounted on an interior surface of the rear wall of the housing and the air gap is formed between the plate portion and a portion of the interior surface of the rear wall of the housing upon which the air gap insulator is mounted.

35. The home cooking appliance of claim 32, wherein the air gap insulator substantially closes off the air gap from the air in the exhaust channel.

36. The home cooking appliance of claim 32, wherein the air gap insulator includes an element for mounting the air gap insulator on the rear wall without direct physical contact between the air gap insulator and the rear wall, and wherein the element includes a first end mounted to the air gap insulator and a second end mounted on the rear wall.

37. The home cooking appliance of claim 32, wherein the air gap insulator includes:

a first flange extending from a first end of the plate portion toward the interior surface of the rear wall; and a second flange extending from a second end of the plate portion toward the interior surface of the rear wall, wherein the plate portion, the first flange, and the second flange cooperate with the interior surface of the rear wall to form the air gap.

38. The home cooking appliance of claim 24, wherein the plate portion includes an emboss that receives a part of the element, and wherein a surface of the emboss facing the rear wall is spaced from the rear wall.

39. The home cooking appliance of claim 1, wherein the air gap insulator includes:

a plate portion configured to be parallel to the rear wall and forming the air gap between the air gap insulator and the rear wall;

a first flange on an upstream side of the plate portion, the first flange including a surface that extends at an angle from the upstream side of the plate portion towards the rear wall and terminates at a first edge facing the rear wall and spaced from the rear wall;

a second flange on a downstream side of the plate portion, the second flange including a surface that extends at an angle from the downstream side of the plate portion to the rear wall and terminates at a second edge facing the rear wall and spaced from the rear wall; and an element for mounting the air gap insulator on the rear wall without direct physical contact between the air gap insulator and the rear wall, the element including a first end mounted to a surface of the air gap insulator that faces the rear wall and a second end mounted on the portion of the rear wall, wherein the plate portion, the first flange, and the second flange cooperate with the rear wall to form the air gap, and the element is disposed in the air gap and arranged between the first edge of the first flange and the second edge of the second flange.

* * * * *